US010697298B2

(12) United States Patent
Kraft et al.

(10) Patent No.: US 10,697,298 B2
(45) Date of Patent: Jun. 30, 2020

(54) OIL-LUBRICATED SLIDE VANE ROTARY VACUUM PUMP WITH OIL SEPARATING AND RECONDITIONING DEVICE

(71) Applicant: Gebr. Becker GmbH, Wuppertal (DE)

(72) Inventors: Artjom Kraft, Bochum (DE); Islam Akyildiz, Dortmund (DE); Markus Loebel, Bochum (DE); Frank Rischewski, Hilden (DE)

(73) Assignee: Gebr. Becker GmbH, Wuppertal (DE)

( * ) Notice: Subject to any disclaimer, the term of this patent is extended or adjusted under 35 U.S.C. 154(b) by 288 days.

(21) Appl. No.: 15/575,055

(22) PCT Filed: May 17, 2016

(86) PCT No.: PCT/EP2016/060988
§ 371 (c)(1),
(2) Date: Nov. 17, 2017

(87) PCT Pub. No.: WO2016/184839
PCT Pub. Date: Nov. 24, 2016

(65) Prior Publication Data

US 2018/0142554 A1 May 24, 2018

(30) Foreign Application Priority Data

May 18, 2015 (DE) ..... 10 2015 107 721

(51) Int. Cl.
*F01C 21/04* (2006.01)
*F03C 2/00* (2006.01)
(Continued)

(52) U.S. Cl.
CPC ..... *F01C 21/007* (2013.01); *F01C 21/10* (2013.01); *F04C 18/344* (2013.01); *F04C 25/02* (2013.01);
(Continued)

(58) Field of Classification Search
CPC ..... F04C 18/344; F04C 25/02; F04C 29/025; F04C 29/026; F04C 29/06; F04C 2230/80;
(Continued)

(56) References Cited

U.S. PATENT DOCUMENTS 2,150,122 A * 3/1939 Kollberg ..... F04C 18/344 418/256
3,669,579 A 6/1972 Carter
(Continued)

FOREIGN PATENT DOCUMENTS

DE 1943504 U 8/1966
DE 20 37 727 A1 2/1971
(Continued)

OTHER PUBLICATIONS

International Search Report of PCT/EP2016/060988, dated Jul. 25, 2016.

*Primary Examiner* — Theresa Trieu
(74) *Attorney, Agent, or Firm* — Collard & Roe, P.C.

(57) ABSTRACT

An oil-lubricated slide vane rotary vacuum pump with a slide vane unit, and with an oil separating and reconditioning device, wherein oil and gas are separated by separating devices, possibly complemented by oil coolers and/or oil pumps. One or more monitoring and/or servicing devices are provided, and the oil separating and reconditioning device is installed in an oil separating and reconditioning housing. Side walls extend transversely to a plane of rotation of a slide vane rotor, and define a longitudinal extent of the oil separating and reconditioning housing. The one or more monitoring and/or servicing devices are arranged only in one or more cover parts which are attached to one or both end walls of the oil separating and reconditioning housing. The oil separating and reconditioning housing is formed with the
(Continued)

side walls, the bottom wall and the top wall without being configured for a monitoring and/or servicing device.

20 Claims, 10 Drawing Sheets

(51) Int. Cl.

| | |
|---|---|
| ***F03C 4/00*** | (2006.01) |
| ***F01C 21/00*** | (2006.01) |
| ***F01C 21/10*** | (2006.01) |
| ***F04C 25/02*** | (2006.01) |
| ***F04C 29/02*** | (2006.01) |
| ***F04C 18/344*** | (2006.01) |

(52) U.S. Cl.
CPC ..... *F04C 29/026* (2013.01); *F04C 2230/80* (2013.01); *F04C 2230/85* (2013.01); *F04C 2240/30* (2013.01)

(58) Field of Classification Search
CPC ..... F04C 2230/85; F04C 2240/30; F04C 2240/809; F04C 2240/81; F01C 21/007; F01C 21/06; F01C 21/0809; F01C 21/10
USPC ..... 418/83, 259, 266–268, 270, DIG. 1
See application file for complete search history.

(56) References Cited

U.S. PATENT DOCUMENTS

| | | | | |
|---|---|---|---|---|
| 4,164,384 | A * | 8/1979 | Hertell | F04C 29/0092 418/47 |
| 4,244,680 | A * | 1/1981 | Ishizuka | F04C 29/026 418/97 |
| 4,269,576 | A * | 5/1981 | Shibuya | F04C 29/026 418/97 |
| 4,283,167 | A * | 8/1981 | Bassan | F04C 23/001 418/13 |
| 2006/0073033 | A1* | 4/2006 | Sundheim | F04C 29/02 418/100 |
| 2010/0183467 | A1* | 7/2010 | Sundheim | F04C 29/02 418/100 |

FOREIGN PATENT DOCUMENTS

| | | | |
|---|---|---|---|
| DE | 10 2007 017 915 | A1 | 10/2008 |
| GB | 134 224 | A | 11/1968 |
| GB | 2 394 007 | A | 4/2004 |

* cited by examiner

OIL-LUBRICATED SLIDE VANE ROTARY VACUUM PUMP WITH OIL SEPARATING AND RECONDITIONING DEVICE

CROSS REFERENCE TO RELATED APPLICATIONS

This application is the National Stage of PCT/EP2016/060988 filed on May 17, 2016, which claims priority under 35 U.S.C. § 119 of German Application No. 10 2015 107 721.3 filed on May 18, 2015, the disclosures of which are incorporated by reference. The international application under PCT article 21 (2) was not published in English.

AREA OF TECHNOLOGY

The invention relates to an oil-lubricated slide vane rotary vacuum pump with a rotary slide vane aggregate, comprised of a rotary slide vane chamber and rotary slide vane rotor, and with an oil separating and reconditioning device, wherein oil and gas are separated in the oil separating and reconditioning device by means of devices, wherein one or more monitoring and/or servicing devices are provided for the mentioned devices, and the oil separating and reconditioning device is accommodated in an oil separating and reconditioning housing, with side walls, a floor wall, a ceiling wall and end walls, wherein the side walls extend transverse to a rotational plane of the rotary slide vane rotor, and define a longitudinal extension of the oil separating and reconditioning housing.

PRIOR ART

Oil-lubricated slide vane rotary vacuum pumps of the kind in question are known. Usually involved here is a rotary slide vane blower with a rotary slide vane housing that forms the rotary slide vane chamber, with said rotary slide vane chamber having the design of a cylindrical borehole. The rotary slide vane rotor is usually cylindrical in design, with sliders arranged so that they can be moved into slits in the rotor. The slits in the rotor can be oriented strictly radially in relation to a cross section through the rotor, or also run at an acute angle to a radial. According to prior art, the rotor is preferably mounted in the area of the lateral cover that closes the respective end of the rotary slide vane housing.

During operation of the vacuum pump, the rotor turns radially offset to the central axis of the rotary slide vane housing. This results in closed chambers, which are separated by the essentially radially movable sliders, and whose size changes during a rotation of the rotor. The change in size yields pressure differences between the individual chambers, and hence between the inlet side and outlet side of the pump.

In oil-lubricated slide vane rotary vacuum pumps, oil is introduced into the rotary slide vane housing. This oil clogs gaps between the various components. Gas exchange between the arising chambers between the sliders is also impeded as a result. In this way, higher vacuums are achieved during operation than with so-called dry running slide vane rotary vacuum pumps.

The type of construction causes the oil to be conveyed out of the last chamber into the outlet along with the conveyed gas. Due to the compression enthalpy in the system, the oil is also heated. The oil can also become contaminated through contact with the conveyed medium or change owing to potential chemical reactions. As a result, the oil is preferably processed after leaving the blower region. Known in this regard is to allow oil to run through the device in a cycle.

Further known is to process the oil in essentially three partial processes. The oil and gas is first separated, if necessary in several stages. The coarse separation of large oil drops through a corresponding filter element can be provided; alternatively or additionally thereto, a gravity and/or impact separation can be provided by redirecting the gas-oil mixture and alternatively or additionally by slowing the flow. A separating device, e.g., a fine separating device, can further be provided for separating the oil and gas, wherein the gas flow is guided through a special filter mat, for example. Another partial process can provide for the degradation of oil foam. Excessively high foam formation or air bubbles trapped in the oil can impede the oil flow through the device, and hence the function of the lubricant and sealant. Another partial process can involve filtering the oil in an oil filter.

One or more monitoring and/or servicing devices can be provided, for example an electrical oil level sensor and/or an oil sight glass and/or an oil temperature monitor.

In addition, it is known to accommodate the oil separating and reconditioning device in an oil separating and reconditioning housing that is separate from the rotary slide vane housing, but potentially coupled thereto. The side walls of such a housing extend transverse to the rotational direction of the rotary slide vane rotor, and hence preferably in essentially the axial direction of extension of the rotary slide vane rotor.

Known from DE 20 37 727 A1 is a slide vane rotary pump which provides a device for separating oil and gas. Monitoring and/or servicing devices are provided for the mentioned device for separating oil and gas at different locations of the aggregate.

SUMMARY OF THE INVENTION

In view of the described prior art, the invention involves the object of further improving a slide vane rotary vacuum pump of the kind in question in terms of handling and/or maintenance and/or production.

This object is initially achieved by an oil-lubricated slide vane rotary vacuum pump wherein emphasis is placed on arranging the one or more monitoring devices in only three cover parts, which are applied to the two end walls of the oil separating and reconditioning housing, and on otherwise designing the oil separating and reconditioning housing with side walls, a floor wall, a ceiling wall and end walls without any embodiment for a monitoring and/or servicing device, wherein a service cover is further allocated to an end wall (18) that is usually at the front during operation, and a removable maintenance cover (33) is provided on the service cover (1), comprising part of the end wall (18).

The cover parts are allocated to the end walls of the oil separating and reconditioning housing. For example, an end wall can be designed as a rear side cover, and a service cover can be allocated to an end wall which is usually at the front during operation. In addition, a removable maintenance cover can be arranged in particular on the service cover for maintenance purposes.

Provided in or on the three cover parts are preferably monitoring and/or servicing devices, and further preferably all monitoring and/or servicing devices relevant during conventional vacuum pump operation. Often used monitoring and/or servicing devices are further preferably provided in the service cover or in the maintenance cover that can be arranged on the service cover, or can be accessed via the latter.

As a result of the proposed embodiment, significant functions lie within the area of the three cover parts, or are to be implemented in the area of the latter. In particular, these functions involve filling in oil and/or checking oil and/or monitoring oil and/or discharging oil and/or attaching oil separating cartridges and/or providing access to oil separating cartridge maintenance and/or attaching a floater unit and/or providing access to the floater unit and/or creating space for separated oil and/or providing a return for accumulated oil and/or providing a receptacle for the maintenance cover and/or dividing into an upper and lower space of the oil separating and reconditioning housing and/or connecting an oil bath heater and/or connecting a water cooler and/or providing a connection for filters and/or a connection for elements downstream from the vacuum pump and/or guiding blown-out air in a defined direction.

The actual oil separating and reconditioning housing without the aforementioned cover parts preferably has no relevant function, at least as relates to the user interface. As a consequence, this housing can be given a simple design. In particular the ceiling wall and floor wall, and further preferably at least also an external side wall, can be designed without any preparations for the arrangement of relevant devices.

In general terms, the floater unit is a controller for the flow from the upper into the lower chamber. In particular, it is influenced by an oil level that arises in the upper chamber. A specifically prescribed oil level is not to be exceeded. It can also be referred to as a so-called valve. For the sake of simplicity, this device is always referred to as a floater unit below.

The mentioned object is further achieved by arranging the one or several monitoring and/or servicing devices on a removable maintenance cover of the oil separating and reconditioning housing, wherein the separating device, which has a floater unit, can be accessed for maintenance purposes upon removal of the maintenance cover, wherein oil separated via the floater unit flows in a housing section (27).

Indicated according to the further proposed solution is an oil-lubricated slide vane rotary vacuum pump that is easy to handle and maintain. The one or several monitoring and/or servicing devices are preferably allocated to a housing area of the oil separating and reconditioning device, with a removable maintenance cover being formed in this area. The monitoring and/or servicing devices can be arranged or formed directly on the maintenance cover, but also in the immediate vicinity of the maintenance cover in the surrounding housing area. This reduces the space required for the slide vane rotary vacuum pump in the area of installation and use. Removing the maintenance cover from the oil separating and reconditioning housing can enable access to components of the oil separating and reconditioning device, in particular access to the separating device, e.g., the fine separator—also called an air de-oiling device—and/or to a floater unit. Such a floater unit can be necessary for allowing the gas to flow through the one or several filter elements in a targeted manner as the result of given pressure differences in the area of the oil separating and reconditioning device during operation of the vacuum pump. Separated oil is here gathered in a cavity, preferably formed in a service cover comprising an end wall of the oil separating and reconditioning housing. Arranged inside the cavity, which can also be referred to as an oil collecting chamber, is a hollow body connected with a joint, preferably a swivel joint, and a gasket. The gasket blocks the oil return. If the oil level rises, the hollow body floats, and the gasket is lifted by the joint, releasing the opening of the oil return.

The maintenance cover is preferably designed and arranged in such a way that the oil located behind it in the oil separating and reconditioning housing cannot exit when removing the maintenance cover.

The maintenance cover is preferably arranged in the area of an end wall of the oil separating and reconditioning housing. The maintenance cover can also be arranged on a service cover allocated to an end wall of the oil separating and reconditioning housing.

Another solution approach provides that the oil separating and reconditioning housing consist of a profile having an identical cross section in terms of its longitudinal extension, specifically an aluminum extruded profile, and an integrally designed chamber system, with a lower and upper chamber in the installation state with respect to gravity.

in particular the housing of the oil separating and reconditioning system can be favorably manufactured in this way. The contour is preferably identical at each point of the longitudinal axis of the housing part.

In relation to an extruded profile, an aluminum wrought alloy is pressed through a two-dimensional die, thereby generating an elongated profile, which can be cut to the preferred length. This makes it possible to manufacture such a housing with dimensionally stable contours over the entire length.

The outer surfaces can be made optically clean and uniform. Additional steps, in particular surface processing steps, can be omitted, in particular when manufacturing out of an extruded profile. In addition, the proposed embodiment of the housing makes it possible to present the surface of the latter as a design-creating element.

The profile having an identical cross section, preferably the extruded profile, provides an opportunity to change the volume of the oil separating and reconditioning device and adjust it to the application needs.

If reference was made above and below to an extruded profile, this must always also be more generally understood as a profile having the same cross section.

It can further be provided that the maintenance cover comprise part of an end wall of the oil separating and reconditioning housing or the end wall as a whole. In the use position of the vacuum pump, the end wall can be facing an operator or control person.

In a preferred embodiment, the maintenance cover tightly covers an opening provided in the end wall of the housing, for example through which the separating device, e.g., the fine separator, and/or the floater can be accessed for maintenance purposes. In terms of its cover surface, the size of the maintenance cover can correspond to 0.25 to 0.5 times the outwardly facing end surface of the end wall.

A separating device is provided to separate the oil and gas, and preferably consists of a filter element and/or a gravity and/or impact separator and/or a fine separator. If reference is made above or below to a separating device, one of the aforementioned embodiments can be involved, without this being indicated in each specific case.

The separating device, e.g., the fine separating device, can carry a flow, and be arranged in the longitudinal direction of the oil separating and reconditioning device with respect to the direction of flow. It is further preferred that the arrangement of the separating device, e.g., the fine separating device, be selected in the direction of longitudinal extension of the housing extruded profile with respect to the direction of flow.

The maintenance cover is preferably arranged in the area of the end wall as an extension of the separating device, e.g., the fine separating device. In the area of its broadside surfaces, the maintenance cover can pass through a longitudinal central axis of the separating device, e.g., the fine separating device, as an extension of the latter.

After the maintenance cover has been removed, a filter element (if provided), preferably in the form of a special filter mat, can first be removed from the separating device, e.g., the fine separating device. For example, it can in this way be easily replaced with a new filter element.

A side wall is provided between the rotary slide vane aggregate and the oil separating and reconditioning device. The side wall of the oil separating and reconditioning housing can here be involved. The side wall can have a passage opening, through which compressed gas with an oil fraction can exit the rotary slide vane aggregate and enter into the oil separating and reconditioning device.

In a first section of the oil separating and reconditioning device, the entering gas with oil fraction can flow countercurrently to a second section, with the separation, e.g., fine separation, of oil and gas taking place in this second section. As is further also preferred, the direction of flow can here be in the longitudinal extension of the oil separating and reconditioning housing, and thus further preferred in the longitudinal extension of the extruded profile. Involved here is an essential direction of flow from one end area of the housing along its longitudinal extension to the other end area of the housing, wherein deviations from a strictly linear direction of flow can be provided within this flow from one to the other end of the housing.

A housing section that adjoins as a flow path can be formed below the passage opening, and oil separated from the gas is made to flow into it through gravitational and/or centrifugal forces. The housing section can serve to accommodate an oil sump, and can thus further be designed as a kind of oil pan. A preferably first separation of gas and oil takes place by way of gravity and/or centrifugal force separation.

In order to allow an oil change, and possibly also the connection of an oil cooling circuit, the housing section has at least one oil outlet opening. As is also preferred, the latter can be formed in a vertically lowest area of the housing section, further preferably near the floor of the latter, with the vacuum pump in an installation and use state. The oil outlet opening is further preferably closeable.

The oil outlet opening can also be accessible from an end wall of the oil separating and reconditioning housing. In a preferred embodiment, the oil outlet opening is allocated to the end wall, on which the maintenance cover is simultaneously also arranged.

In particular for precipitating particles from the oil separated from the gas, an oil filter can further be provided in the housing section or allocated thereto, and oil located in the housing section can be guided through it. As is preferred, this can be a replaceable oil filter.

The oil guided through the oil filter can preferably be introduced into the rotary slide vane chamber. To this end, a pump can be provided, which aspirates the oil accumulating in the housing section through the oil filter and conveys it into the rotary slide vane chamber of the rotary slide vane aggregate. Preference goes to a design without a pump, in which the pressure difference between the oil collecting chamber and working area of the vacuum pump is used for conveying the oil.

A filter mat can be provided in the separating device, e.g., the fine separating device. This filter mat is preferably replaceable, wherein such a replacement in a preferred embodiment takes place from the one end wall exhibiting the maintenance cover after the maintenance cover has been removed.

The filter mat can be tubular in design, with an inner flow path for the gas/oil mixture. Oil separated out in the separating device, e.g., fine separating device, in a preferred embodiment flows into the housing section exhibiting the oil collecting chamber by way of the floater unit.

The flow resistance of the filter mat results in a pressure difference in front and back of the separating device. Depending on the volume flow currently conveyed by the pump, the latter can measure up to 400 mbar. This pressure difference makes the floater unit necessary, since the gas would otherwise circumvent the fine separating device and flow directly to the gas outlet.

The floater unit can be situated directly on the maintenance cover or, as is preferred, be accessible once the maintenance cover has been removed. This also improves maintenance.

A fill level indicator can also be provided on the end wall, if necessary in or on the maintenance cover. The oil fill level of the vacuum pump can be read from the latter. A conventional sight glass can here be involved, or alternatively an analog or digital measurement display.

A relief valve or bursting disk can also be arranged in the end wall, if necessary in the maintenance cover. Such a relief valve or bursting disk serves as a safeguard against a sudden overpressure in the device. Given a possible arrangement of a bursting disk in the maintenance cover, a reliable operating status can once again be easily restored in terms of handling after an event, for example by changing out the maintenance cover.

In another embodiment, a temperature monitoring element can be arranged in the end wall, if necessary in the maintenance cover or allocated to the maintenance cover. This is used in particular for monitoring the oil temperature.

In a preferred embodiment, the gas separated from the oil can exit through the end wall, further preferably through the maintenance cover. To this end, the end wall, in particular the maintenance cover, has a corresponding outlet opening.

In a preferred embodiment, the maintenance cover has a gas outlet nozzle. The latter can be designed for connecting a silencer or continuation element. In a first embodiment of the maintenance cover, the gas outlet nozzle can further be equipped with a thread. Outlet piping can be connected thereto. The thread can also be used for connecting a bursting valve. If necessary, the bursting valve can also be arranged and fastened in the outlet piping. If needed, a pipeline, a silencer or even other gas conveying elements can be connected. By changing out the maintenance cover, a correspondingly equipped maintenance cover can also be arranged with the device located at the operation site.

In a second embodiment, the gas outlet nozzle can be provided with a potentially removable deflection cap, in which the exiting gas is deflected by at least 60° relative to its outlet direction at the gas outlet nozzle. The deflection is preferably selected in such a way that the exiting gas flows out downwardly directed. This reduces the noise during vacuum pump operation, since the sound is directed in one direction toward the floor. The gas outlet nozzle can also be rotatably arranged on the maintenance cover, thereby also enabling a lateral or upward deflection, for example.

The oil separating and reconditioning housing can have an integrally designed chamber system, with a lower and upper chamber in the installation state with respect to gravity, wherein an end wall can be connected on the front and rear sides in the longitudinal direction of the oil separating and reconditioning housing. The integral configuration of chambers can be fabricated with an extruded profile during the preferred manufacture of the housing. In a preferred embodiment, the upper chamber serves in particular to accommodate the separating device, e.g., the fine separating device, while the lower chamber with the vacuum pump in operation forms the housing section described above. The end walls to be connected each form an end-side termination of the oil separating and reconditioning housing. One of the end walls can have an opening covered by the maintenance cover described above.

At least one end wall here preferably comprises a connection between the chambers. Given a preferred, counter-directed flow inside of the chamber, at least one end wall can form gas deflection areas.

In a preferred embodiment, the passage opening from the rotary slide vane aggregate or from the rotary slide vane chamber to the oil separating and reconditioning device empties into the lower chamber of the oil separating and reconditioning housing. The gravity and/or impact separator preferably adjoins this passage opening viewed in the direction of flow.

In a preferred embodiment, the lower chamber further comprises an oil collecting tank.

One or several cooling lines preferably integrated into the extruded profile can be provided, and allocated to the oil collecting tank. Inlets and outlets for cooling the oil with an external cooler can also be provided in the area of the oil collecting tank.

BRIEF DESCRIPTION OF THE DRAWINGS

The invention is explained in more detail below based on the attached drawing, which only describes an exemplary embodiment. Shown on:

FIG. 7 is a perspective view of the vacuum pump after removing an end wall and an oil separating and reconditioning housing;

DESCRIPTION OF THE EMBODIMENTS

Figure 1:
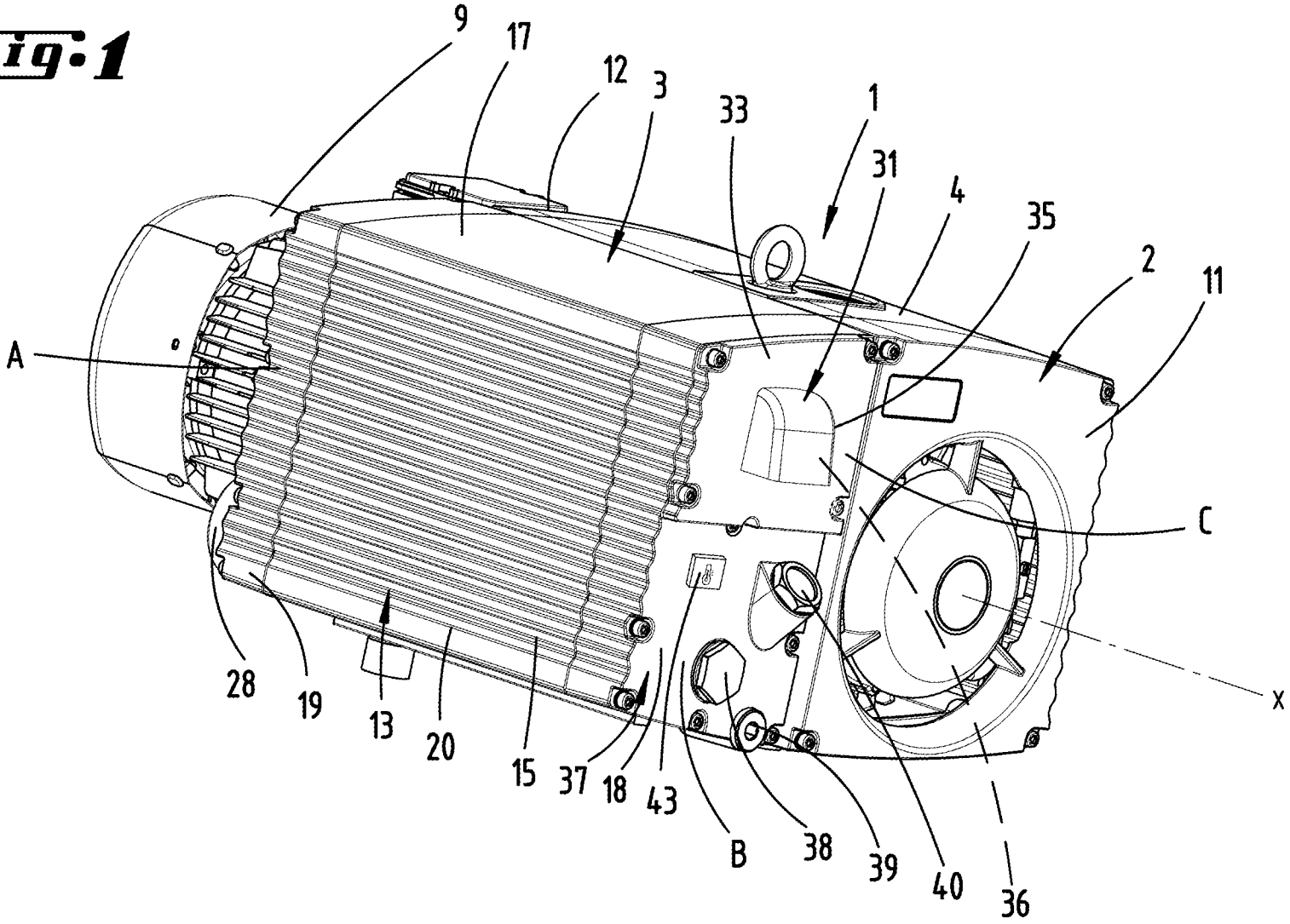
FIG. 1 is a perspective view of an oil-lubricated slide vane rotary vacuum pump.
Figure 2:
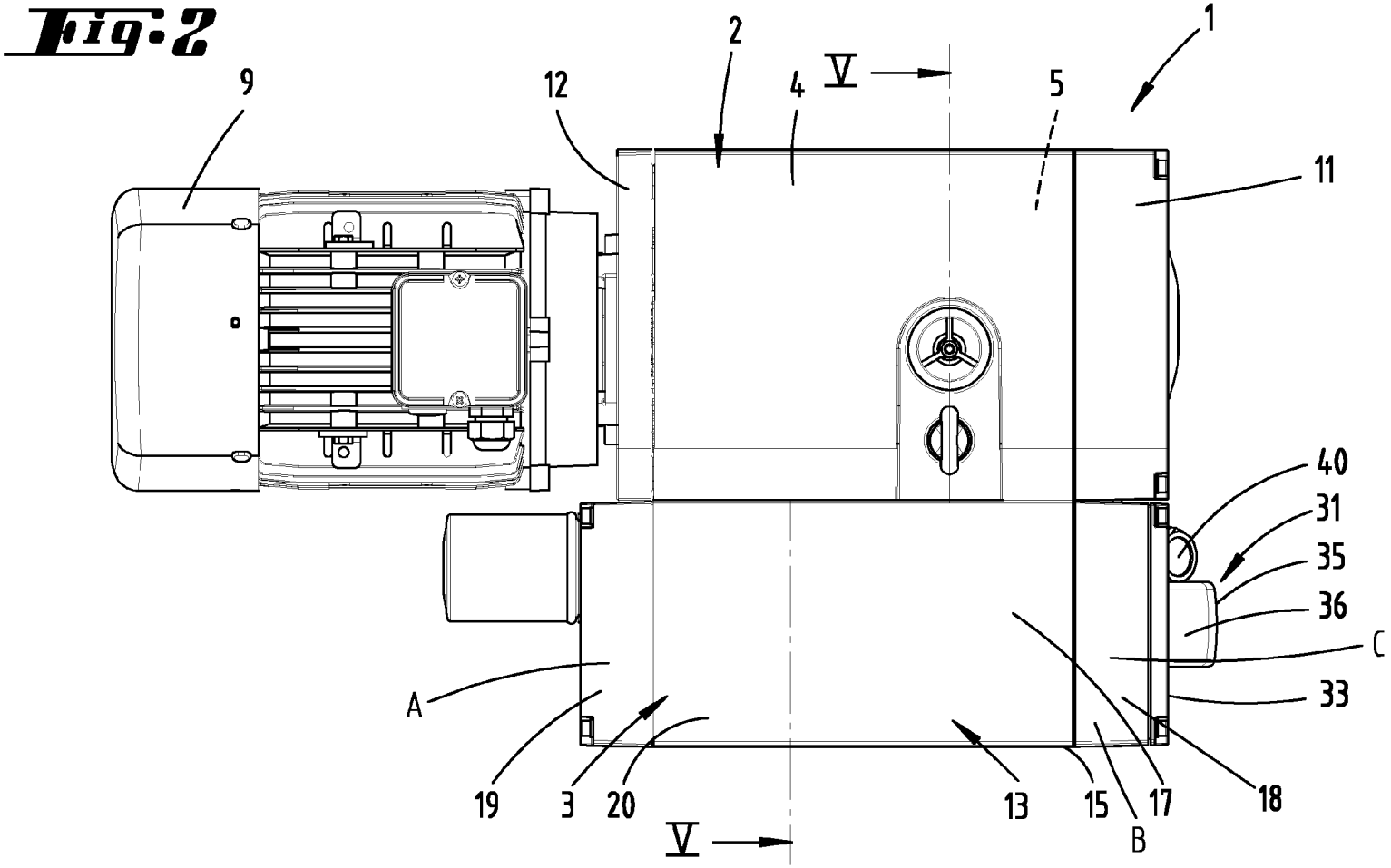
FIG. 2 is a top view thereof.
Figure 3:
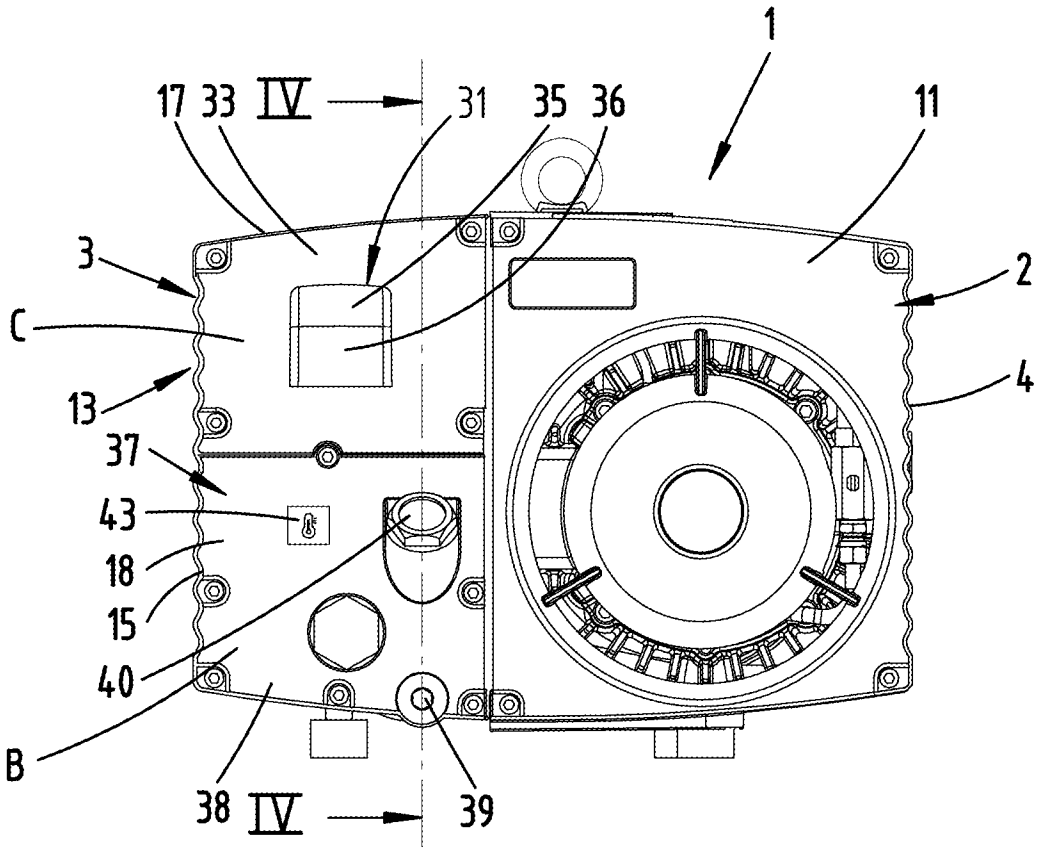
FIG. 3 is a side view of the vacuum pump, with focus on a side wall with a maintenance cover.
Figure 4A:
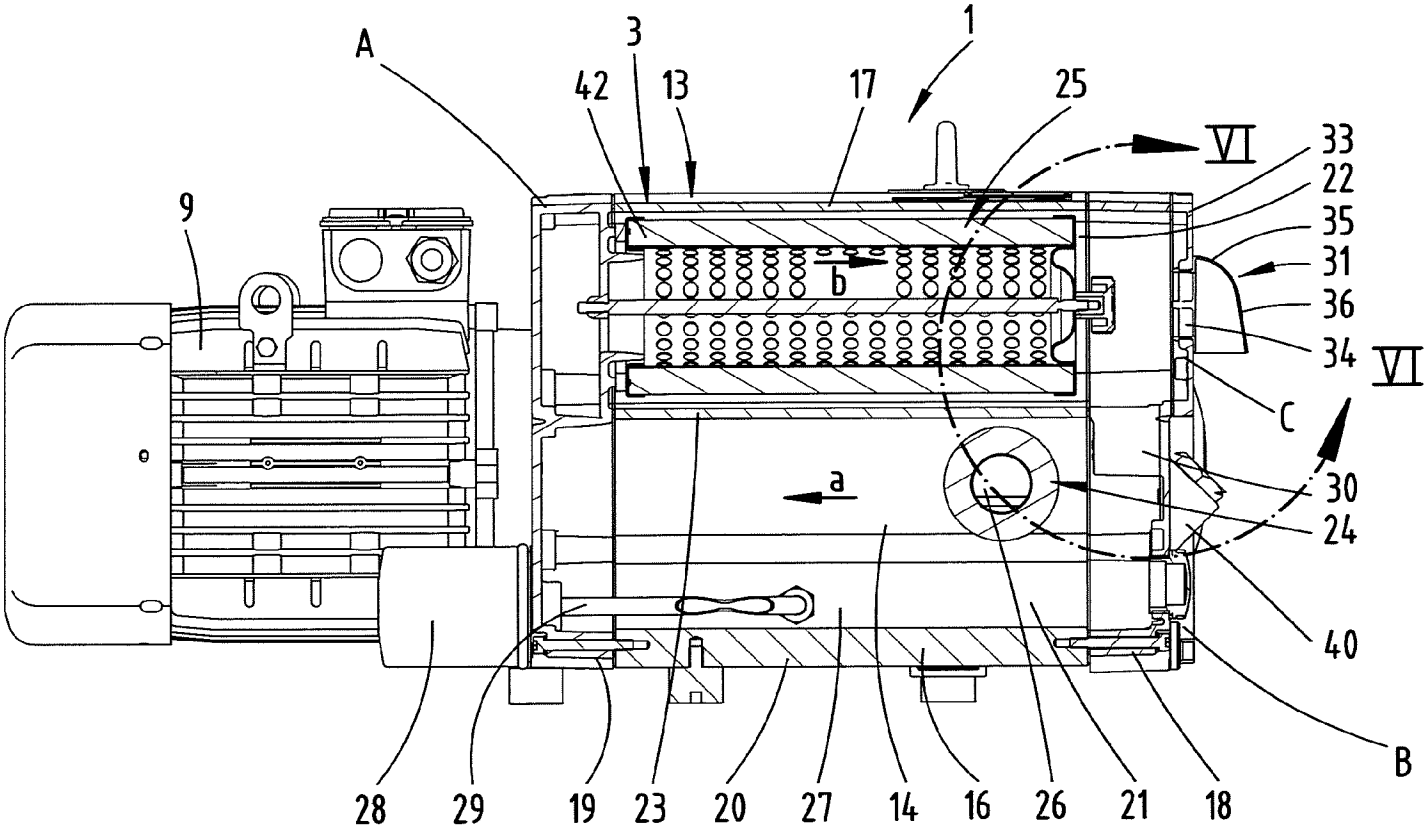
FIG. 4A is the section according to line IV-IV on FIG. 3.
Figure 4B:
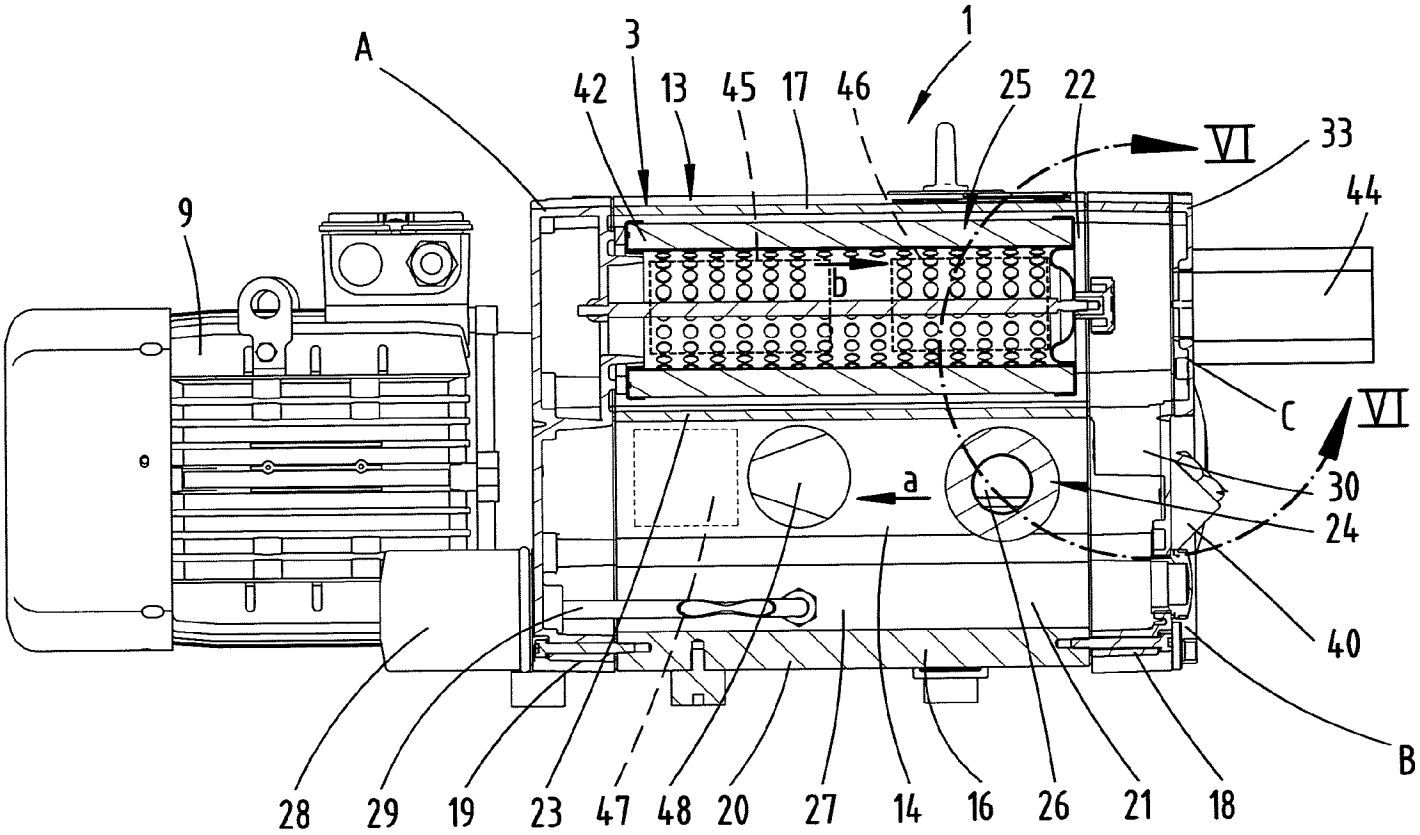
FIG. 4B is the section shown in FIG. 4A in which the deflection cap 36 has been replaced and the cap outlet connects with the silencer 44.
Figure 5:
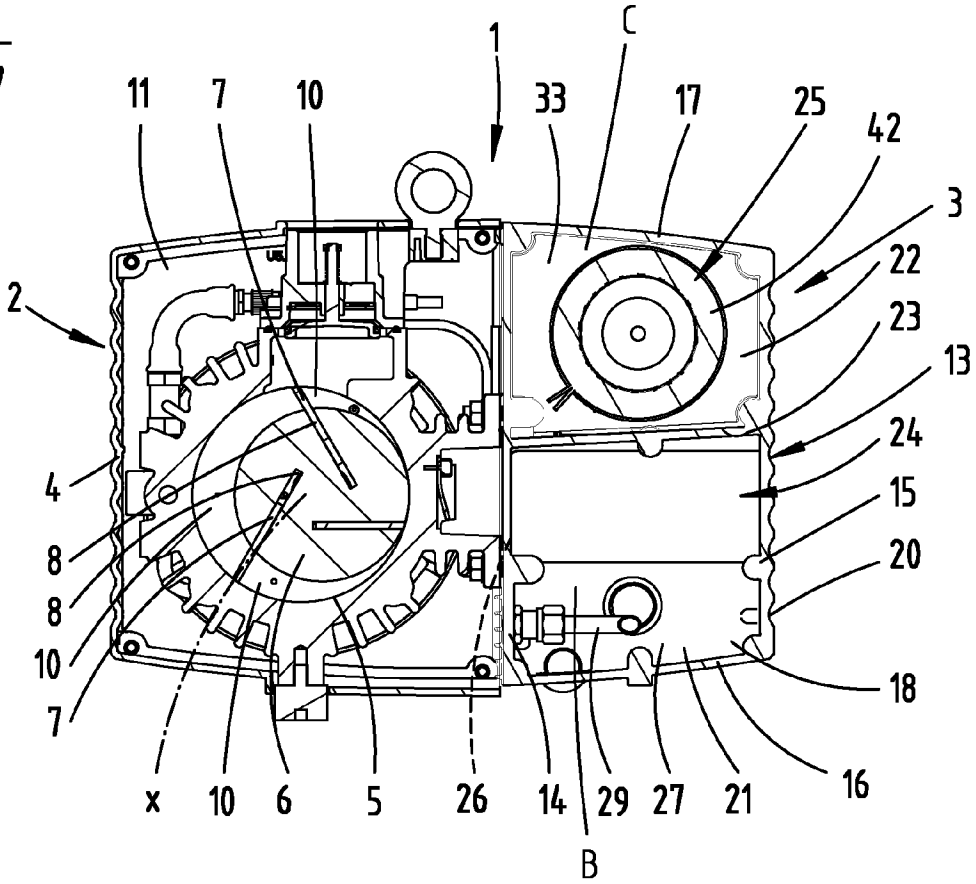
FIG. 5 is the section according to line V-V on FIG. 2.
Figure 6:
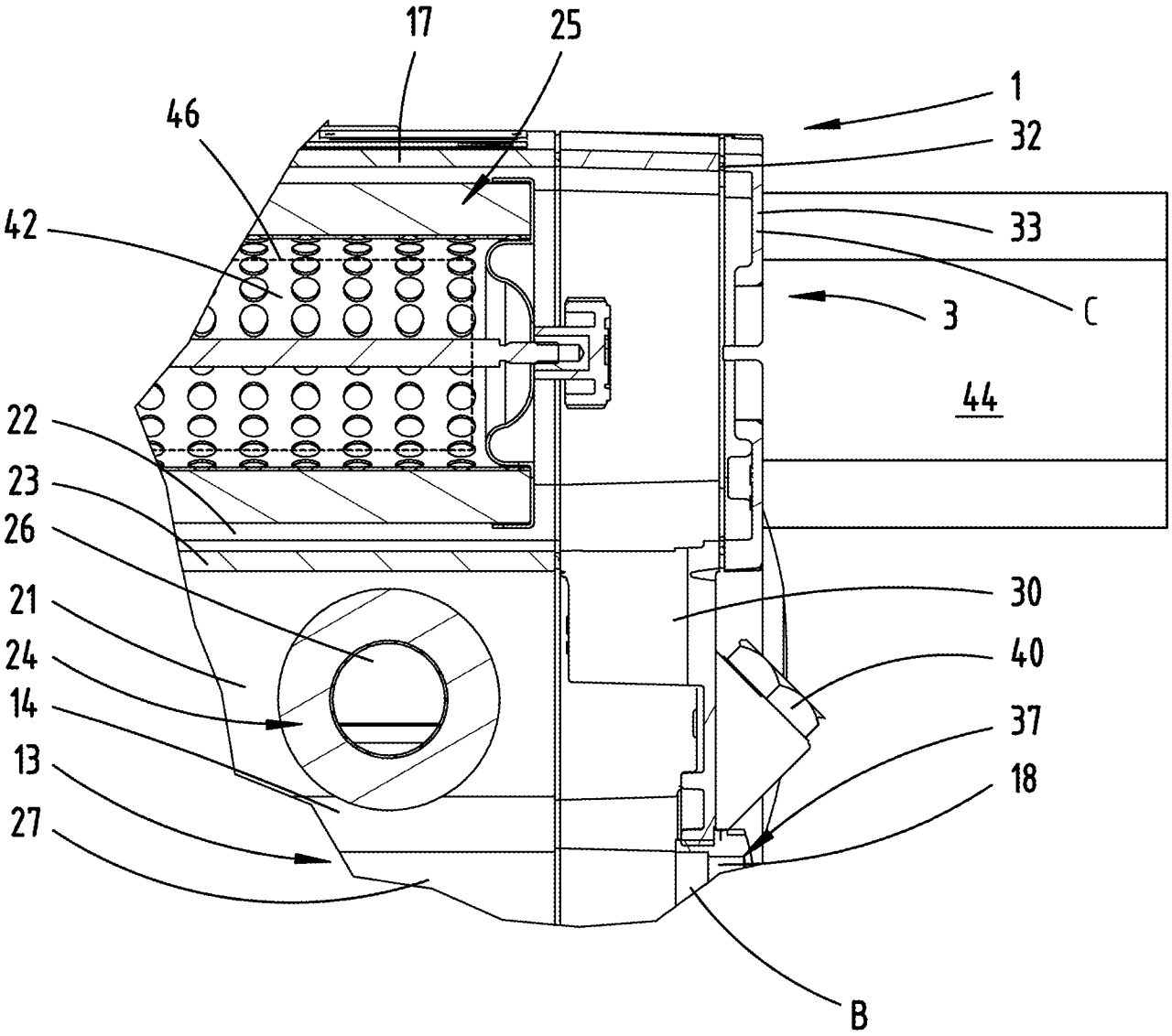
FIG. 6 is an outward magnification of the VI area on FIG. 4B.

Shown and described initially with reference to FIG. 1 is an oil-lubricated slide vane rotary vacuum pump 1 with a rotary slide vane aggregate and an oil separating and reconditioning device 3.

The rotary slide vane aggregate 2 has an aggregate housing, which incorporates a rotary slide vane chamber 5 with a rotary slide vane rotor 6, and is covered by a hood 4.

The rotary slide vane chamber 5 takes the form of a cylindrical borehole in the aggregate housing. The rotary slide vane chamber 5 has a longitudinal extension oriented to the borehole axis of the rotary slide vane chamber 5.

The cylindrical rotary slide vane rotor 6 is eccentrically arranged relative to the rotary slide vane chamber 5. Correspondingly, the rotor axis x runs parallel but offset to the spatial axis.

The rotary slide vane rotor 6 has several slide vanes 7, three in the exemplary embodiment. In cross section, the latter are slidably arranged in slots 8 of the rotor 6, which are roughly radially oriented. The slide vanes 7 are pressed against the wall bordering the rotary slide vane chamber 5 by the rotation of the rotary slide vane rotor 6.

With the vacuum pump 1 in operation, the rotary slide vane rotor 6 rotates radially offset to the central axis of the rotary slide vane chamber 5 as the result of being driven by a motor that rotationally acts on the rotor shaft, in particular an electric motor 9. Separated by the radially displaceably arranged slide vanes 7, this yields closed chambers 10, whose size changes as the rotary slide vane rotor 6 rotates.

In relation to its longitudinal axis, the rotary slide vane chamber 5 is closed at its respective end by an air guiding hood 11 and a motor flange 12, which can provide a mount for the rotary slide vane rotor 6.

Outside of the aggregate housing, for example allocated to the motor flange 12, the electric motor 9 is preferably fastened to the aggregate housing. The shaft of the rotary slide vane rotor 6 can penetrate through the corresponding motor flange for the non-rotational engagement of the electric motor 9.

The change in size of the chambers 10 with the vacuum pump 1 in operation results in pressure differences between the individual chambers 10, and hence between the inlet side and outlet side of the blower formed in this way.

The drive via the electric motor 9 can be arranged directly on the rotor shaft or, as further preferred, by way of a coupling.

Oil-lubricated rotary slide vane aggregates 2 are now characterized by the fact that, in the latter, oil is introduced into the rotary slide vane chamber 5. This oil closes gaps between the different components, in particular between the slide vanes 7 and the wall of the rotary slide vane chamber 5. This impedes gas exchange between the different chambers 10. In this way, higher vacuums are achieved during operation than possible for dry running slide vane rotary pumps.

The type of construction causes the oil to be conveyed out of the last chamber 10 of the rotary slide vane aggregate 2 along with the conveyed gas. Due to the compression enthalpy in the system, the oil is also heated. Since the oil comes into contact with the conveyed medium (gas), it can become contaminated or change owing to potential chemical reactions.

The oil cycles through the vacuum pump 1. As a result, it must be prepared after leaving the rotary slide vane aggregate 2. The oil separating and reconditioning device 3 is used for this purpose.

The device 3 is connected with the rotary slide vane aggregate 2, thereby yielding a unit comprised of the rotary slide vane aggregate, oil separating and reconditioning device 3 and electric motor 9.

The oil separating and reconditioning device 3 initially has an oil separating and reconditioning housing 13, with side walls 14, 15, a floor wall 16, a ceiling wall 17 and floater units 18, 19.

The side walls 18 and 19 are viewed in the longitudinal extension of the housing 13, wherein said longitudinal extension corresponds to the longitudinal extension of the rotary slide vane chamber 5 of the rotary slide vane aggregate 2, respectively arranged at the end side of the housing integrally forming the side walls 14 and 15, floor wall 16 and ceiling wall 17, in particular connected with the housing by a screw. The end wall 18 is preferably formed by a service cover, and the end wall 19 by a rear side cover.

In terms of its longitudinal extension, the housing 13 can consist of an extruded profile 20, in particular of an aluminum extruded profile. The oil separating and reconditioning housing 13 has an essentially constant cross section over its length, while maintaining a dimensionally stable contour as viewed over the longitudinal extension. In addition, the outer surfaces are optically uniform and clean in design when manufacturing the housing 13 in the extrusion process, obviating the need for surface treatment steps to optically upgrade the surface. Only necessary processing steps can be provided, for example perforations in the side walls and/or floor wall and/or ceiling wall.

The housing 13 can also be manufactured in the extrusion process in such a way that, apart from the surface, the shape of the housing can be designed so that the latter ultimately represents the design-creating element.

The side walls 14 and 15 extend transverse to a rotational plane of the rotary slide vane rotor 6, wherein the side wall 14 in the exemplary embodiment shown simultaneously represents the fastening plane for fastening the oil separating and reconditioning housing 13 to the aggregate housing.

In a possible embodiment, the side walls 18 and 19 arranged at the respective end side terminate with the adjacent air guiding hood 11 and motor flange 12, as further preferably do the cover wall 17 and floor wall 16 with the adjacent wall sections of the aggregate housing that follow the latter. This yields a compact and visually appealing unit.

Figure 11:
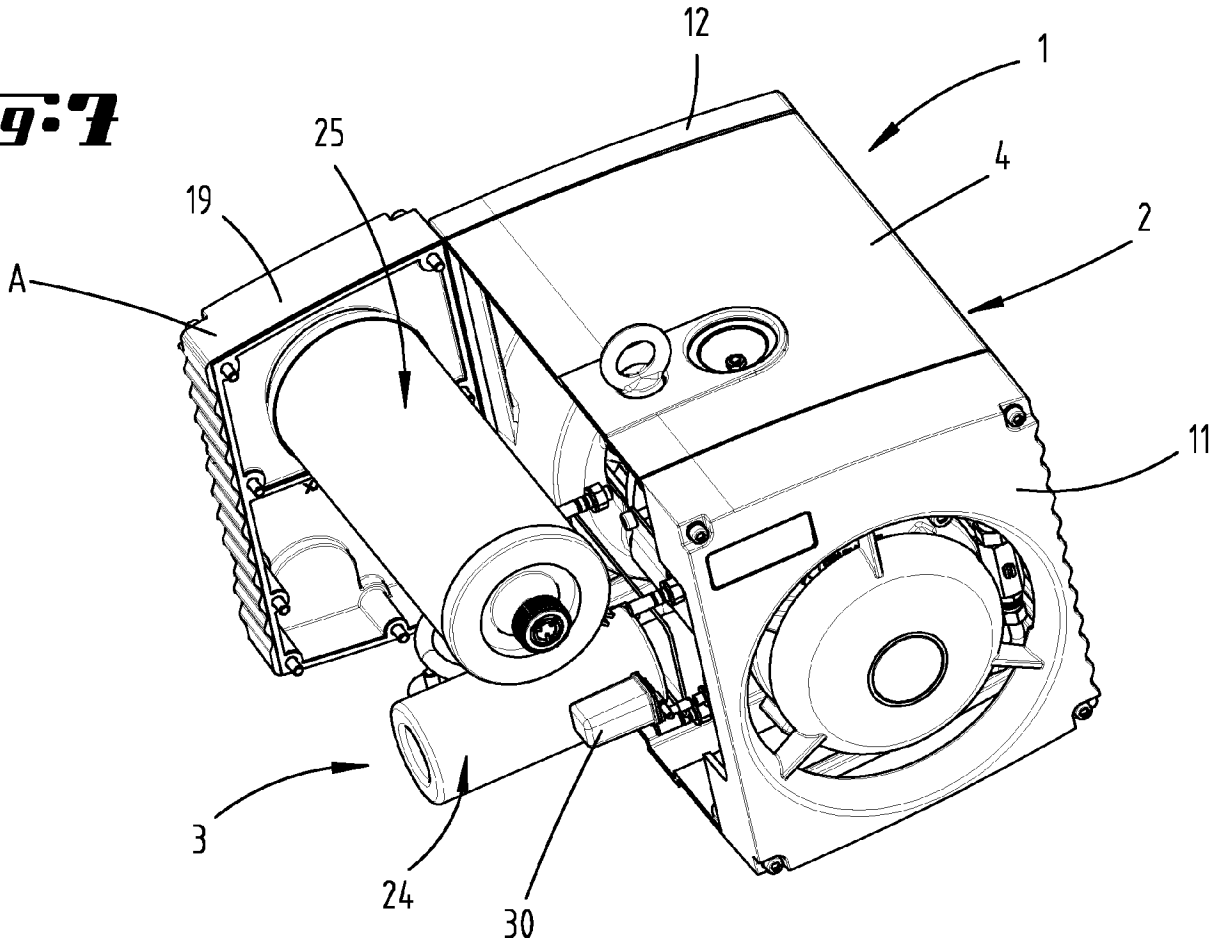
FIG. 11 is a sectional view of the oil separating and reconditioning housing.
Figure 9:
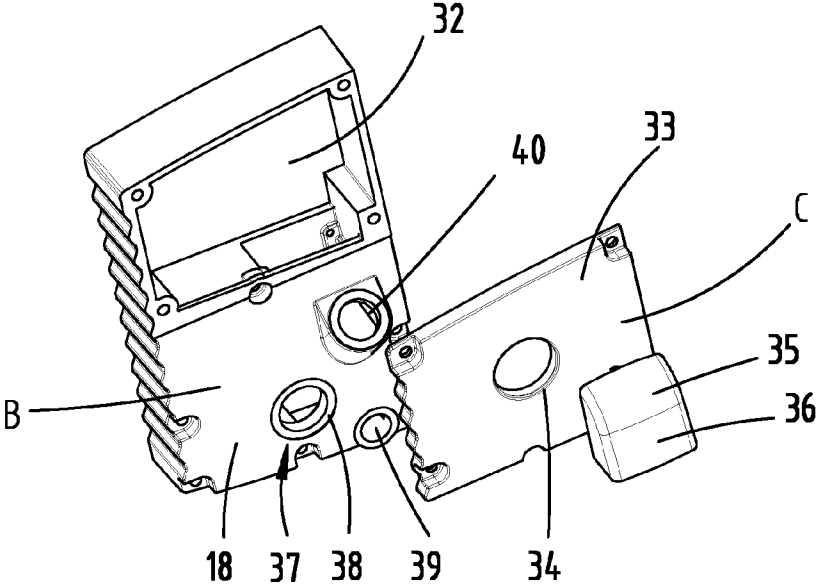
FIG. 9 is a perspective, individual view of the side wall removed on FIG. 7 with allocated maintenance cover and a gas outlet nozzle that can be secured to the maintenance cover.
Figure 8:
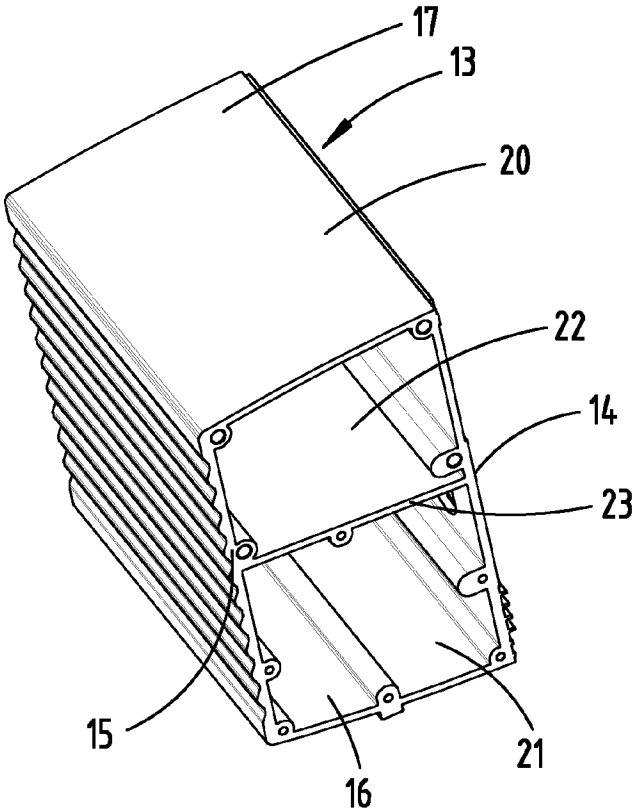
FIG. 8 is a perspective, individual view of the oil separating and reconditioning housing.
Figure 11:
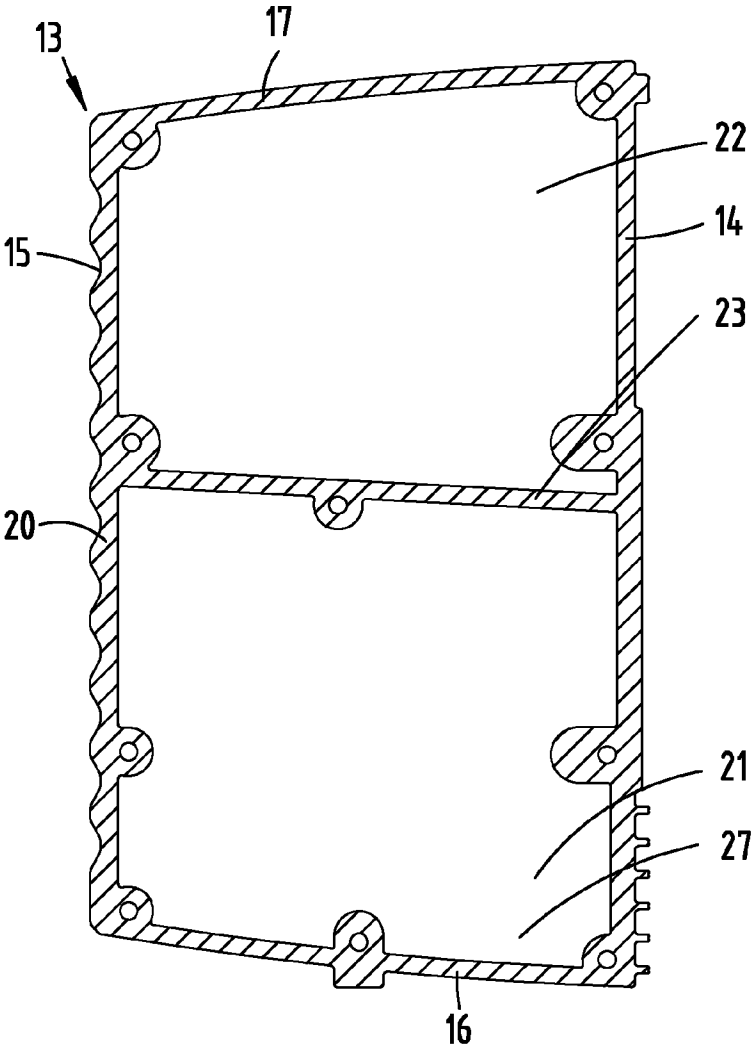
Figure 10:
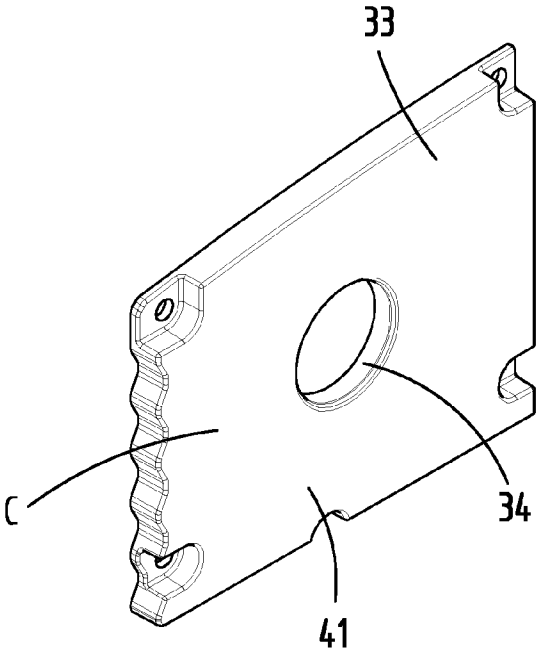
FIG. 10 is another perspective view of the maintenance cover, with focus on the inner surface in the use state.

The outer surface of the side wall 15 that faces away from the rotary slide vane aggregate 2, and thus faces toward the outside, has an undulating design with respect to a cross section in the rotational plane of the rotary slide vane rotor 6 (see in particular FIG. 11). Uniform, rounded elevations arise over the extension length of the side wall 15 viewed in cross section, and are connected with each other by valleys. This enlarges the surface in the area of the side wall 15, and thus improves heat dissipation with the vacuum pump 1 in operation.

In a preferred embodiment, the shaft surface continues in the facing surface areas of the end walls 18 and 19.

The oil separating and reconditioning housing 13 has a preferably integrally designed chamber. In reference to an installation state as already shown, a lower chamber 21 and an upper chamber 22 arise with respect to gravity. The chambers 21 and 22 are separated by a separating web 23 that runs transverse to the side walls 14 and 15 with respect to a cross section according to FIG. 11.

With the vacuum pump 1 in operation, in particular a separation of oil and gas takes place in the oil separating and reconditioning device.

Provided to this end is a gravity and/or impact separator 24 and a separating device 25, e.g., the fine separating device, as well as a filter element 45, an oil cooler 47 and a pump 48.

The oil/gas mixture exits the rotary slide vane aggregate 2 through a passage opening 26 in the area of the side wall 14 and enters into the oil separating and reconditioning device 3.

During entry into the device 3, large oil drops are preferably first coarsely separated using the gravity and/or impact separator 24 by diverting the gas-oil mixture and slowing the flow.

The oil-gas mixture enters into the device 3 by correspondingly arranging the passage opening 26 in the area of the lower chamber 21, in which the gravity and/or impact separator 24 is correspondingly arranged.

The housing section 27 arising under the passage opening 26 in the area of the lower chamber 21 serves as a kind of oil pan, in which an oil sump accumulates. In this way, an oil collecting tank is formed in the lower chamber 21.

The lower chamber 21 further forms a flow path with a flow a oriented to the longitudinal alignment of the housing. This flow a is directed toward the rear end wall 19.

The interior wall side of the end wall 19 is designed to divert the flow from the lower chamber 21 into the upper chamber 22, in which the flow path formed in the upper chamber 22 permits a flow b opposite to the flow a of the lower chamber 21.

The separating device 25, e.g., the fine separating device, is arranged in the upper chamber 22.

The separating device 25, e.g., the fine separating device, has a tubular filter mat 42, whose tubular axis is preferably co-directional relative to the rotor axis x of the rotary slide vane rotor 6. The separating device 25, e.g., the fine separating device, is further essentially oriented in the longitudinal direction of the oil separating and reconditioning housing 13.

The oil-gas mixture diverted from the lower chamber 21 into the upper chamber 22 is guided through the separating device 25, e.g., the fine separating device, in a targeted manner, wherein a pressure difference arises in front and back of the separating device 25, e.g., the fine separating device, which can measure up to 400 mbar depending on the conveying pressure of the rotary slide vane aggregate 2.

An oil foam degrading device 46 for separating oil and gas can further be provided in the oil separating and reconditioning device 3.

An oil filter 28 is also provided. It can be allocated to the floor area of the oil separating and reconditioning housing 13, further preferably to the rear end wall 19. The oil in the oil sump is aspirated through the oil filter 28, and in particular freed of solid particles.

The oil filtered in the oil filter 28 is conveyed into the rotary slide vane aggregate 2 via the suction line 29, utilizing the pressure difference between the lower chamber 21 and chamber 10 in the rotary slide vane aggregate 2.

An external cooler (not shown) can be used to cool in particular the filtered oil. To this end, corresponding inlets and outlets are provided in the area of the lower chamber 21.

Cooling paths can also be provided in the profile of the housing 13, for example in the area of the floor wall 16 and/or the side walls 15 (allocated to the lower chamber 21).

The end wall 18 preferably facing an operator in the use state leaves a passageway on the interior side of the wall for connecting the upper chamber 22 with the lower chamber 21, wherein this passageway consists of a floater unit 30. Oil deposited on the separating device 25, e.g., the fine separating device, is routed back into the reservoir in the area of the lower chamber 21, specifically through the floater unit 30. As a result of the pressure difference described above in front and back of the separating device 25, e.g., the fine separating device, this prevents a short circuiting type of flow of the gas entering into the lower chamber 21 through the passage opening 26 directly to the gas outlet 31.

In addition, an oil bath heater can be provided to heat the oil before starting the vacuum pump 1.

An additional water cooler can also be provided.

The oil bath heater and/or the water cooler can be arranged on the end wall 19.

In the end wall 18 that faces away from the electric motor and during operation comprises a front side, a front A window-like opening 32 allocated to the upper chamber 22 and extending at least approximately over the entire cross sectional area of the upper chamber 22 is provided. The latter is closed by a maintenance cover 33 with the vacuum pump 1 in operation. The maintenance cover 33 can be screwed with the end wall 18, preferably with a gasket interspersed.

The gas outlet 31 is provided in the maintenance cover 33. To this end, the maintenance cover 33 has a through opening 34, which is adjoined by a gas outlet nozzle 35 on the external wall side of the maintenance cover 33.

The gas outlet nozzle 35 is designed as a removable deflection cap 36, in which the exiting gas, relative to its alignment present at the gas outlet nozzle, which is essentially co-directional to the flow b in the upper chamber, is downwardly deflected by at least 60°, preferably by up to 90° toward the plane given by the floor wall 16. As a result, the sound is directed toward the floor, which helps to reduce noise.

The gas outlet nozzle 35 is preferably rotatably arranged on the maintenance cover 33, so that the exhaust air can optionally also be laterally or upwardly diverted, for example.

The deflection cap 36 can be replaced, for example with a gas outlet nozzle for connecting a silencer 44 or continuation element.

In addition, a maintenance cover 33 with deflection cap 36 can be replaced with a maintenance cover 33 for connecting an external piping, for example.

The oil separating and reconditioning device 3 has several monitoring and/or servicing devices 37. A fill level indicator 38 for determining oil quantity can be provided in the end wall 18 allocated to the lower chamber 21. Fill level indicator 38 can consist of an oil sight glass and/or an electrical oil level sensor.

A possible oil temperature display can also be arranged in the area of the end wall 18.

Furthermore, both the inlet and outlet for changing the oil in the oil separating and reconditioning device 3 can be provided in the end wall 18. In one embodiment, an oil outlet opening 39 and filler nozzle 40 are provided in the end wall 18.

After the maintenance cover 33 allocated to the end wall 18 has been removed, the separating device 25, e.g., the fine separating device, and the floater unit 30 are accessible for maintenance and possible replacement from the operating side of the vacuum pump 1.

In addition, a relief valve can be arranged in the maintenance cover 33.

The relief valve serves as a safeguard against a sudden overpressure in the oil separating and reconditioning device 3; therefore, it is preferably part of the monitoring device.

The end walls 18 and 19 along with the maintenance cover 33 are allocated directly or indirectly to the oil separating and reconditioning housing 31 as cover parts A, B and C (cover part C or maintenance cover 33).

As a result of the above described arrangement of the monitoring and/or servicing devices 37 along with the configuration of the cover parts A, B and C, preferably all interfaces relevant to the operator are conveniently accessibly accommodated in the area of the end walls 18, 19, thereby reducing the space required for the device, increasing maintainability and making it easier to manufacture the oil separating and reconditioning housing. A temperature monitoring element 43 can be arranged in the end wall 18, 19, if necessary in the maintenance cover 33.

REFERENCE LIST

1 Vacuum pump
2 Rotary slide vane aggregate
3 Oil separating and reconditioning device
4 Hood 30
5 Rotary slide vane chamber
6 Rotary slide vane rotor
7 Slide vane
8 Slit
9 Electric motor
10 Chamber
11 Air guiding hood
12 Motor flange
13 Oil separating and reconditioning device
14 Side wall
15 Side wall
16 Floor wall
17 Ceiling wall
18 End wall
19 End wall
20 Extruded profile
21 Lower chamber
22 Upper chamber
23 Separating web
24 Gravity and/or impact separator
25 Separating device
26 Passage opening
27 Housing section
28 Oil filter
29 Suction line
30 Floater unit
31 Gas outlet
32 Opening
33 Maintenance cover
34 Passage opening
35 Gas outlet nozzle
36 Deflection cap
37 Monitoring and servicing device
38 Fill level indicator
39 Outlet opening
40 Filler nozzle
42 Filter mat
a Flow
b Flow
x Rotor axis
A Cover part
B Cover part
C Cover part

The invention claimed is:

1. An oil-lubricated slide vane rotary vacuum pump (1) with a rotary slide vane aggregate (2), comprised of a rotary slide vane chamber (5) and a rotary slide vane rotor (6), and with an oil separating and reconditioning device (3), wherein oil and gas are separated in the oil separating and reconditioning device (3) by means of one or more monitoring or servicing devices (37), and the oil separating and reconditioning device (3) is accommodated in an oil separating and reconditioning housing (13), with side walls (14, 15), a floor wall (16), a ceiling wall (17) and end walls (18, 19), wherein the side walls (14, 15) extend transverse to a rotational plane of the rotary slide vane rotor (6), and define a longitudinal extension of the oil separating and reconditioning housing (13), wherein, in terms of its longitudinal extension, the oil separating and reconditioning housing (13) comprises an aluminum extruded profile, and has an integrally designed chamber system, with a lower chamber (21) and upper (22) chamber in an installation state with respect to gravity.

2. The slide vane rotary vacuum pump according to claim 1, wherein the one or more monitoring or servicing devices (37) are arranged only in one or several cover parts (A, B, C), which are secured to one or both end walls (18, 19) of the oil separating and reconditioning housing (13), and wherein the oil separating and reconditioning housing (13) otherwise comprises the side walls (14, 15), floor wall (16) and ceiling wall (17) without a configuration for the one or more monitoring or servicing device (37).

3. The slide vane rotary vacuum pump according to claim 2, wherein a fine separating device (25) is provided, and wherein a filter mat (42) is provided in the fine separating device (25).

4. The slide vane rotary vacuum pump according claim 1, wherein the one or more monitoring or servicing devices (37) are arranged on one removable maintenance cover (33) of the oil separating and reconditioning device (3), wherein a fine separating device $(25)_7$ is provided and is configured to be accessed for maintenance after removing the maintenance cover (33).

5. The slide vane rotary vacuum pump according claim 4, wherein the maintenance cover (33) forms part of one of the end walls (18, 19) of the oil separating and reconditioning housing (13), or forms one of the end walls (18, 19) as a whole.

6. The slide vane rotary vacuum pump according to claim 4, wherein the fine separating device (25) that is configured to carry a flow and is arranged in the longitudinal direction of the oil separating and reconditioning device (3) in terms of a direction of flow (b).

7. The slide vane rotary vacuum pump according to claim 4, wherein the fine separating device (25) is has a floater unit (30), and wherein oil separated in the fine separating device (25) flows into the housing section (27) by way of the floater unit (30).

8. The slide vane rotary vacuum pump according to claim 4, wherein a fill level indicator (38) is provided on one of the end walls $(18, 19)_7$ or in the maintenance cover (33), or a relief valve or bursting disk (41) is arranged in one of the end walls (18, 19) or in the maintenance cover (33), or a temperature monitoring element is arranged in one of the end walls (18, 19), or in the maintenance cover (33), or one of the end walls or maintenance cover is configured so that gas conveyed through one of the end walls (18, 19) or through the maintenance cover (33) exits, or the maintenance cover (33) has a gas outlet nozzle (35).

9. The slide vane rotary vacuum pump according to claim 8, wherein the maintenance cover has the gas outlet nozzle (35) and the gas outlet nozzle is provided with a removable deflection cap (36), in which the exiting gas is deflected by at least 60° relative to its outlet direction at the gas outlet nozzle (35).

10. The slide vane rotary vacuum pump according to claim 4, wherein the fine separating device (25) is arranged in the upper chamber (22), wherein the fine separating device (25) has a fine separator realized by a filter element, or oil and gas are separated by an oil foam degrading device.

11. The slide vane rotary vacuum pump according to claim 1, wherein the lower chamber (21) comprises an oil collecting tank.

12. The slide vane rotary vacuum pump according to claim 11, wherein one or several cooling lines integrated into the extruded profile (20) are provided, and allocated to the oil collecting tank.

13. The slide vane rotary vacuum pump according to claim 1, wherein a one of the side walls (14, 15) has a passage opening (26) between the rotary slide vane aggregate (2) and the oil separating and reconditioning device (3), the passage opening being configured for allowing compressed gas with an oil portion to enter into the oil separating and reconditioning device (3), wherein the passage opening (26) empties into the lower chamber (21).

14. The slide vane rotary vacuum pump according to claim 13, wherein a housing section (27) is formed underneath the passage opening (26) as an adjoining flow path, into which oil separated from the gas enters through exposure to gravity or centrifugal force, or the housing section (27) has an oil outlet opening (39) that is configured to be accessed from one of the end walls (18, 19) of the oil separating and reconditioning housing (13) and further comprising an oil filter (28) that is configured such that the oil located in the housing section (27) is guided through the oil filter (28).

15. The slide vane rotary vacuum pump according to claim 14, wherein the rotary slide vane chamber (5) is configured such that the oil guided through the oil filter (28) is introduced into the rotary slide vane chamber (5).

16. The slide vane rotary vacuum pump according to claim 1, wherein the slide vane rotary pump is configured such that gas enters into the slide vane rotary vacuum pump, and the entering gas with oil portion flows in a first section of the oil separating and reconditioning device (3) in a countercurrent (a) to a second section, in which fine separation takes place.

17. The slide vane rotary vacuum pump according to claim 1, wherein one of the end walls (18) has a maintenance cover (33) with a gas outlet nozzle (35) or a maintenance cover (33) that is configured for connecting a silencer or a continuation element.

18. The slide vane rotary vacuum pump according to claim 1, wherein at least one of the end walls (18, 19) comprises a connection between the chambers (21, 22).

19. The slide vane rotary vacuum pump according to claim 1, wherein oil and gas are separated by a filter element or oil and gas are separated by a gravity or impact separator.

20. The slide vane rotary vacuum pump according to claim 1, wherein at least one of an oil cooler and an oil pump is provided.

* * * * *